United States Patent [19]

Neff

[11] 4,438,418

[45] Mar. 20, 1984

[54] LOW-WATTAGE SOLENOID

[75] Inventor: James A. Neff, Bloomfield Township, Oakland County, Mich.

[73] Assignee: Mac Valves, Inc., Wixom, Mich.

[21] Appl. No.: 399,784

[22] Filed: Jul. 19, 1982

[51] Int. Cl.[3] ..... H01F 7/08

[52] U.S. Cl. ..... 335/255; 335/262

[58] Field of Search ..... 335/251, 255, 258, 260, 335/261, 262

[56] References Cited

U.S. PATENT DOCUMENTS 3,900,822 8/1975 Hardwick ..... 335/262

4,044,324 8/1977 Coors ..... 335/262

FOREIGN PATENT DOCUMENTS 2713144 10/1977 Fed. Rep. of Germany ..... 335/262

*Primary Examiner*—George Harris

*Attorney, Agent, or Firm*—Robert G. Mentag

[57] ABSTRACT

A solenoid assembly including a C-shaped support frame having a transverse member and a pair of leg members. A solenoid coil is mounted within the support frame. A flux plate is releasably mounted between a support frame leg member for retaining the solenoid coil in the support frame. A pole piece is movably mounted in an axial bore through the solenoid coil, and through the flux plate. A solenoid armature is movably mounted in the other end of the bore and said solenoid coil. A first and second bushing are operatively mounted in the axial bore in the solenoid coil. Each of the guide bushings has a circular flange and an integral tubular body.

3 Claims, 3 Drawing Figures

LOW-WATTAGE SOLENOID

TECHNICAL FIELD

This invention relates generally to solenoids, and more particularly to low-wattage solenoids adapted for use in operating a valve spool, and like members.

BACKGROUND ART

It is known in the solenoid art to provide solenoids having spring biased pole pieces to overcome tolerance problems in valves. An example of such a prior art solenoid is disclosed in U.S. Pat. No. 3,538,954. A disadvantage of such prior art solenoids is that they are not self-contained, and the parts thereof must be disassembled and reassembled individually when maintenance and repair operations are required. A further disadvantage of such prior art solenoids is that they are noisy, because of misalignment between the moving parts thereof. In order to overcome the disadvantages of the aforementioned solenoids, it was proposed to provide a self-contained solenoid which could be inserted and removed from a valve construction as a complete unit, so as to reduce lost parts, maintenance, repair time and the cost of the same. The self-contained solenoid was provided with a floating tubular guide member for maintaining alignment of the solenoid plunger and a spring biased movable pole piece. However, a disadvantage for low-wattage solenoids of the last described tubular guide member is that the transfer of the magnetic flux is inefficient from the solenoid coil into the magnetic components, namely, the frame, the pole piece and the armature. In order to increase the efficiency of the transfer of magnetic flux, the thin guide tube was used with magnetic bushings and non-magnetics bushing for guiding the pole piece and the armature. An example of a prior art solenoid provided with a thin guide tube for the pole piece and armature is disclosed and described in U.S. Pat. No. 4,100,519.

DISCLOSURE OF THE INVENTION

In accordance with the present invention a low-wattage solenoid is provided in which the flux created by the solenoid coil is efficiently transferred into the magnetic components of the solenoid, namely, the frame, the pole piece and the armature. The solenoid of the present invention is adapted for use in operating a valve spool, and other like members.

A solenoid assembly made in accordance with the invention includes a C-shaped support frame having a transverse member and a pair of leg members. A solenoid coil assembly is mounted within the support frame. A flux plate is releasably mounted between the support frame leg members for retaining the solenoid coil assembly. A pole piece is movably mounted in an axial bore through the solenoid coil assembly and through the flux plate, and it is guided for axial movement by a first bushing mounted in the flux plate. Said first bushing has a transverse flange which is seated against the outer transverse face of the flux plate, and an integral tubular body which extends telescopically inward along approximately one-half the length of the pole piece in one end of the axial bore in the solenoid coil assembly. A solenoid plunger or armature is movably mounted in the other end of said bore in said solenoid coil assembly, and it is guided for axial movement by a second bushing mounted in the support frame transverse member. Said second bushing has a flange seated on the outer transverse face of the support frame transverse member and an integral tubular body that extends telescopically inward around the solenoid armature for approximately one-half the length thereof, and in sliding contact therewith. The inner ends of each of the pole piece and solenoid armature members are provided with an enlarged diameter portion which is disposed inwardly of the inner ends of the two bushings in the coil assembly axial bore. The first and second bushings are made from a suitable magnetic material.

BEST MODE OF CARRYING OUT THE INVENTION

Figure 3:
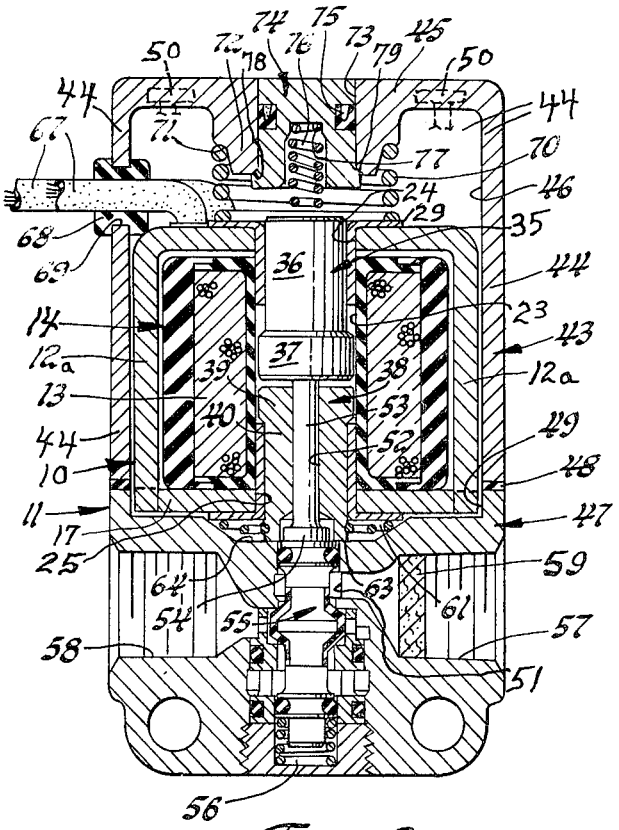
FIG. 3 is an elevation section view of a low-wattage solenoid made in accordance with the principles of the present invention, and shown operatively mounted on a three-way reversing valve for operating the valve spool of said valve.

Referring now to the drawings, and in particular to FIG. 3, the numeral 10 generally designates a solenoid sub-assembly made in accordance with the principles of the present invention. The numeral 11 generally designates a three-way reversing valve operated by the solenoid sub-assembly 10. However, it will be understood that the solenoid of the present invention may be employed to operate other types of solenoid operated reversing valves, as for example, a two-way reversing valve or a four-way reversing valve, and the like. The solenoid of the present invention is adapted for use in any application wherein compensation is required for tolerances between a first operative position and a second operative position of a valve stem or other member movable by a solenoid.

Figure 1:
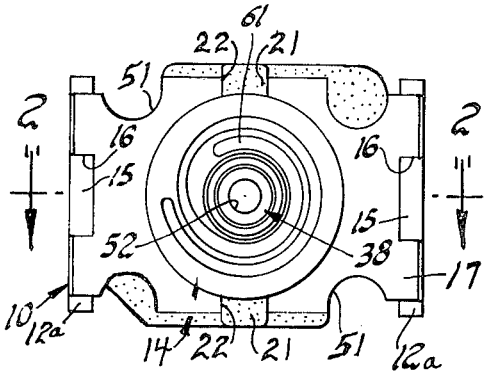
FIG. 1 is a bottom view of a low-wattage solenoid sub-assembly made in accordance with the principles of the present invention.
Figure 2:
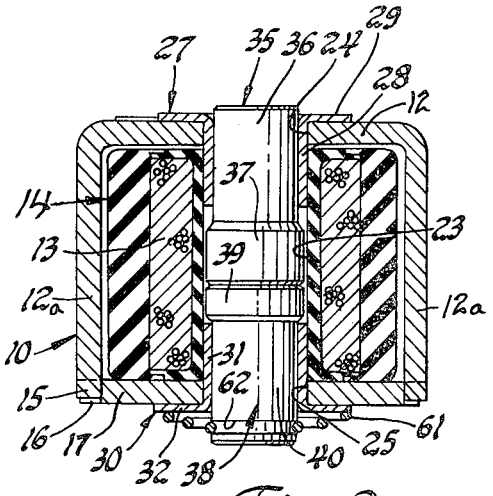
FIG. 2 is an elevation section view of the solenoid sub-assembly structure illustrated in FIG. 1, taken along the line 2—2 thereof, and looking in the direction of the arrows.

As shown in FIGS. 1 through 3, the solenoid sub-assembly 10 includes a "C"-shaped coil assembly support frame that includes a transverse plate or bight portion 12, and a pair of internal side plates or legs 12*a*. As shown in FIGS. 2 and 3, a coil 13 is operatively mounted in a solenoid coil assembly, generally indicated by the numeral 14. The solenoid coil assembly 14 is mounted inside of the "C"-shaped coil assembly support frame with its one end against the inside of the transverse plate 12 and the other end retained in the support frame by a suitable flux plate 17. As best seen in FIG. 1, the flux plate 17 is provided at each end thereof with a notch 16 that receives a projection 15 on the end of the adjacent support frame leg 12*a*. The flux plate 17 is snapped in place against the support frame legs 12*a* to hold the aforedescribed solenoid coil assembly 14 in a self-retaining assembly, which can be quickly and easily removed or inserted as a unit. The coil assembly 14 is free to move a slight amount within the support frame structure comprising the "C"-shaped support frame and the flux plate 17.

As shown in FIG. 1, the solenoid coil assembly 14 is encapsulated in a molded plastic material casing which is provided with a pair of projecting rectangular, integral locating members 21, formed integral with the casing thereof, which are seated in locating slots 22 formed in diametrical opposite positions along the sides of the flux plate 17.

As shown in FIGS. 2 and 3, the coil assembly 14 is provided with an axial bore 23 which is aligned with an axial bore 24 formed through the support frame transverse plate 12, and an axial bore 25 formed through the flux plate 17. As shown in FIG. 2, a first bushing, generally indicated by the numeral 27, has a tubular elongated body 28 mounted within the bore 23 of the solenoid coil assembly 14 and the bore 24 through the support frame transverse plate 12. A transverse, flat circular flange 29 is integrally formed on the outer end of the first or upper bushing body 28, and it is seated against the outer face of the support frame transverse plate 12. A second bushing, generally indicated by the numeral 30, is operatively mounted in the other end of the axial bore 23 of the solenoid coil assembly 14. The bushing 30 includes a cylindrical or tubular body portion 31 which is mounted in the axial bore 23 in the solenoid coil assembly 14. The bushing 30 has an integral transverse, circular flat flange 32 which is adapted to be disposed against the outer lower face of the flux plate 17. The bushings 27 and 30 are made from any suitable magnetic material, as or a steel alloy of any sort which is used for magnets.

As shown in FIGS. 2 and 3, a solenoid plunger or armature, generally indicated by the numeral 35, has a main cylindrical body portion 36 slidably mounted within a close tolerance through the first bushing cylindrical body portion 28, so as to be telescopically mounted therethrough. An integral, enlarged diameter inner end portion 37 of the armature 35 is slidably mounted within the axial bore 23 formed through the solenoid coil assembly 14, in a portion of the bore 23 between the inner ends of the first bushing body 28 and the second bushing body 31.

As shown in FIGS. 1, 2 and 3, the solenoid sub-assembly 10 includes a spring-biased pole piece, generally indicated by the numeral 38. The pole piece 38 has a cylindrical body portion 40 which is slidably mounted in the cylindrical body 31 of the second lower bushing 30. A very close tolerance is maintained between the outer diameter of the pole piece body portion 40 and the inner diameter of the bushing body 31. The inner end of the pole piece 38 is provided with an enlarged diameter integral end portion 39 which is mounted inwardly beyond the inner end of the bushing body 31. The spring-biased pole piece 38 is provided with an annular groove 62 (FIG. 2) around the outer end of the cylindrical body portion 40. One end of a coil spring 61 is retained in the groove 62, and the other end is seated against the outer face of the bushing flange 62.

As shown in FIG. 3, the solenoid sub-assembly 10 is adapted to be slidably mounted inside a cover, generally indicated by the numeral 43, which has a body that is rectangular in transverse cross section shape. The cover 43 is open at the lower end thereof, and it is provided with an interior body chamber 46 so that the cover 43 is telescopically mounted over the solenoid sub-assembly 10. The cover 43 includes the rectangular body side walls 44, and an integral upper end wall 45. The cover body side walls 44 are seated on a suitable gasket 48 which is disposed on the upper mating wall portions on the valve body, generally indicated by the numeral 47. As shown in FIG. 3, the lower end of the solenoid sub-assembly 10 extends downwardly from the cover 43 into a recess 49 formed in the upper end of the valve body 47.

The solenoid cover 43 is adapted to be secured to the valve body 47 by any suitable means, as by a pair of suitable machine screws 50 (FIG. 3). The support frame top end plate 12 is provided with suitable half-round openings (not shown) along the side edges thereof to allow the screws 50 to pass thereby, and to further retain the solenoid sub-assembly 10 in place. The flux plate 17 has similar openings 51 (FIG. 1). As shown in FIG. 3, the spring 61 biases the pole piece 38 downwardly to seat its end face 63 against the end wall 64 of the valve body 47 so as to provide a floating pole piece that functions as the pole piece described in said prior U.S. Pat. No. 3,538,954.

As shown in FIG. 3, a valve spool extension cylindrical rod 53 is slidably mounted through an axial bore 52, formed through the pole piece 38. The inner end of the valve spool extension 53 abuts the inner end of the solenoid plunger or armature 35, and the outer end 54 thereof engages the upper end of the poppet stem 55, as shown in FIG. 3.

The poppet stem 55 is movably mounted in a valve stem bore 51 formed through the valve body 47. The valve 11 includes an inlet or supply port 57 that communicates through the valve stem bore 51 with a fluid delivery or cylinder port 58. The supply port 57 has a suitable filter screen 59 mounted therein. A spring 56 normally biases the poppet stem 55 upwardly to a first position, shown in FIG. 3, to block fluid flow between the inlet port 57 and the delivery port 58, and to connect the delivery port 58 to an exhaust port (not shown). The solenoid sub-assembly 10 functions to move the poppet stem 55 downwardly to a second position to connect the inlet port 57 with the delivery port 58, and to block fluid flow between the delivery port 58 and the exhaust port. A detailed description of the structure and operation of a valve similar to the valve 11 may be found in U.S. Pat. No. 3,538,954.

Numeral 67 designates the conventional lead wires for the solenoid coil assembly 14. The lead wires 67 are mounted through an opening 69 formed in one of the side walls 44 of the cover 43, and they are held in place by a suitable grommet 68. A load spring 70 is seated in the solenoid cover 43, in the upper end thereof, and its upper end abuts a recess 71 in the outer side of an axial boss 72 which is integrally formed on the inner side of the cover top end wall 45. The lower end of the load spring 70 abuts the outer upper side of the upper bushing flange 29. The load spring 70 is centrally disposed within the cover 43, and it functions to bias the solenoid sub-assembly 10 into position against the valve body 47.

A manual operator, generally indicated by the numeral 74, is slidably mounted in a bore 73 in the axial boss 72 on the top end of wall 45 of the cover 43. The operator 74 is shown in an inoperative position in FIG. 3. A spring 76 has its outer end seated in a friction gripping engagement in an axial bore 77 that is formed in the inner end of the operator 74. When the operator 74 is in the inoperative position, as shown in FIG. 3, the inner end of the spring 74 does not engage the outer end of the armature 35, but is slightly spaced apart therefrom in close proximity thereto. A suitable cup seal 75 is mounted around the operator 74, and it engages the bore 73. The inner end of the bore 73 is tapered outwardly to form an angular tapered seat 78 against which the outwardly tapered angular shoulder 79 on the operator 74 is seated when the operator 74 is in the inoperative position shown in FIG. 3.

In operation, the solenoid 10 is in the initial position shown in FIG. 3. When it is desired to move the poppet stem 55 downwardly to a second operative position, the solenoid assembly 10 is energized and the plunger 35 is pulled downwardly so as to overcome the force of spring 56. When the poppet stem 55 reaches a second operative position, the movable pole piece 38 is raised upwardly magnetically to seat against the lower end of the armature 35 and effect a magnetic seal between the pole piece 38 and the armature 35. Upon de-energization of the coil 13, the spring 56 moves the poppet stem 55 upwardly to its initial position, and the spring 61 moves the pole piece 38 to its initial position, shown in FIG. 3.

The solenoid sub-assembly 10 of the present invention, includes an efficient core guide for a direct current low wattage solenoid so as to effect a maximum transfer of flux created in the coil 13 into the magnetic components of the solenoid, namely, the C-shaped frame 12, 12*a*, and the armature 35, and pole piece 38. The upper and lower core flanges 27 and 30, with their circular flanges 29 and 32, and their tubular extensions 28 and 31 respectively, function to transfer the magnetic flux into their respective core halves, namely, the armature 35 and pole piece 38, respectively, so as to provide an optimum longitudinal pull between the armature 35 and the pole piece 28, and a minimum amount of lateral pull on these core parts. The self-retaining structure of the solenoid assembly permits maintenance and repair operations to be carried out quickly and efficiently. The present invention is applicable to both direct current and alternating current low-wattage solenoids. The invention reduces the wattage required in an A.C. low-wattage solenoid, and it increases the power and efficiency of a D.C. low-wattage solenoid.

INDUSTRIAL APPLICABILITY

The improved solenoid structure of the present invention is particularly adapted for use in low wattage solenoids, and especially in solenoids adapted for use in operating a valve spool, and like members. The valve spool operated by the solenoid sub-assembly of the present invention is of the type adapted for use in valves for controlling the operation of an air cylinder in either one direction or both directions. The air cylinder would be employed in various types of industrial machines.

I claim:

1. A solenoid assembly, including, a support frame having a transverse member and a pair of leg members, a solenoid coil mounted within the support frame, a flux plate releasably mounted between the support frame leg members for retaining the solenoid coil in the support frame, a pole piece movably mounted in one end of an axial bore through the solenoid coil and through the flux plate, a solenoid armature movably mounted in the other end of said axial bore through said solenoid coil, and guide means for guiding the movement of the pole piece and armature in the axial bore through the solenoid coil, characterized in that said guide means includes:

(a) a first bushing mounted on the flux plate, and having a transverse flange which is seated against an outer transverse face of the flux plate, and an integral tubular body which extends inward through the flux plate and into the axial bore in the solenoid coil and telescopically along the pole piece and in sliding contact therewith; and, (b) a second bushing mounted on the support frame and having a flange seated on an outer transverse face of the support frame transverse member and an integral tubular body that extends inward through the support frame transverse member and telescopically along the solenoid armature and in sliding contact therewith.

2. A solenoid assembly as defined in claim 1, characterized in that:

(a) the inner ends of each of the pole piece and solenoid armature members are provided with an enlarged diameter integral portion which is disposed inwardly of the inner ends of the two bushings in the axial bore in the solenoid coil.

3. A solenoid assembly as defined in claim 2, characterized in that:

(a) the integral tubular body of said first bushing extends telescopically inward along approximately one-half the length of the pole piece; and, (b) the integral tubular body of said second bushing extends telescopically inward around the armature for approximately one-half the length thereof.

* * * * *